US006916405B2

(12) United States Patent
Wolf et al.

(10) Patent No.: US 6,916,405 B2
(45) Date of Patent: Jul. 12, 2005

(54) PROCESS AND DEVICE FOR DRYING OF A MATERIAL WEB

(75) Inventors: Robert Wolf, Herbrechtingen (DE); Markus Oechsle, Bartholomae (DE); Wolfgang Mayer, Heidenheim (DE); Thomas Mack, Sontheim (DE); Roland Mayer, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 10/259,402

(22) Filed: Sep. 30, 2002

(65) Prior Publication Data

US 2003/0024133 A1 Feb. 6, 2003

Related U.S. Application Data

(63) Continuation of application No. 09/662,001, filed on Sep. 14, 2000, now Pat. No. 6,482,295.

(30) Foreign Application Priority Data

Sep. 15, 1999 (DE) ..... 199 44 267

(51) Int. Cl.[7] ..... D21F 11/00; D21J 1/00

(52) U.S. Cl. ..... 162/207; 162/205; 162/206; 162/202; 34/41; 34/94; 34/116; 34/117; 34/119; 34/120; 34/392

(58) Field of Search ..... 162/207, 205, 162/206, 202; 34/41, 94, 116, 117, 119, 120, 392

(56) References Cited

U.S. PATENT DOCUMENTS 3,149,025 A 9/1964 Dickens
3,367,035 A 2/1968 Tomlinson
3,914,875 A 10/1975 Schiel
3,981,084 A 9/1976 Sobota
4,359,827 A 11/1982 Thomas
4,361,466 A 11/1982 Wong et al.
4,461,095 A 7/1984 Lehtinen
4,467,529 A 8/1984 Candor
5,383,288 A * 1/1995 Ilmarinen ..... 34/392
6,004,430 A 12/1999 Ilvespaa et al.

FOREIGN PATENT DOCUMENTS

| | | |
|---|---|---|
| DE | 6609043 | 2/1972 |
| DE | 19723532 | 12/1998 |
| DE | 19755510 | 6/1999 |
| DE | 19816931 | 10/1999 |
| WO | 82/02937 | 9/1982 |

OTHER PUBLICATIONS

English Language Abstract of WO 99/52707.

* cited by examiner

*Primary Examiner*—Mark Halpern
(74) *Attorney, Agent, or Firm*—Greenblum & Bernstein, P.L.C.

(57) ABSTRACT

Process and apparatus for drying a material web. The process includes guiding the material web to at least one heated area having a jacket surface of a cylinder having a diameter of between about 4–10 meters, setting the material web, having a dry content of between about 45–55%, onto the at least one heated area, maintaining the material web in uninterrupted contact with the at least one heated area at least until the material web achieves a firmness sufficient for detaching the material web from the heated area, and detaching the material web from the at least one heated area with a dry content of between about 55%–65%.

27 Claims, 2 Drawing Sheets

PROCESS AND DEVICE FOR DRYING OF A MATERIAL WEB

CROSS-REFERENCE TO RELATED APPLICATIONS

The present application is a continuation of U.S. patent application Ser. No. 09/662,001 filed Sep. 14, 2000, now U.S. Pat. No. 6,482,295, which claims priority under 35 U.S.C. § 119 of German Patent Application No. 199 44 267.3 filed Sep. 15, 1999. Further, the disclosures of the above-noted documents are expressly incorporated by reference herein in their entireties.

BACKGROUND OF THE INVENTION

1. Field of the Invention

The invention relates to a process for drying of a material web, in particular a paper or a cardboard web. The invention further relates to a device for drying a material web as well as a drying section of a machine for producing a material web.

2. Discussion of Background Information

In conventional multi-cylinder drying sections, the material web to be dried is guided over a steam heated cylinder or over an arrangement of steam heated cylinders and wire suction rolls. Especially at the beginning of drying, problems occur in the guidance of the web which are caused, in particular, by the fact that the still-moist material web, not yet having sufficient consistency, adheres to the smooth contact surfaces that are necessary for sufficient heat conductivity. This often leads to web breaks and to an over stretching of the web seams. Coating the cylinders can reduce these problems only to an insufficient degree. This results in the necessity of slowing the drying process, which lengthens the necessary drying section. The problems mentioned above occur increasingly at higher web travel speeds.

SUMMARY OF THE INVENTION

The present invention to create a possibility for drying material webs as fast as possible in secured guidance and at web travel speeds as high as possible.

In particular, the present invention provides for the material web to be introduced to at least one heated area and to remain in uninterrupted contact with the heated area until the web achieves a sufficient consistency be lifted off the heated area.

According to the invention, the separation of the material web from the heated area is omitted as long as the material web is not firm enough to be lifted off without any problems—and in particular without adhering to the heated area. In contrast to multi-cylinder drying groups of single or multiple rows, in which the material web is only briefly in contact with the separate drying cylinders and is set successively onto an area and is lifted off an area in short intervals, according to the invention, the material web remains longer in contact with the heated area so that the material web can solidify without the interruptions of being set down onto and being lifted off from an area.

According to the invention, the material web to be dried is intentionally guided along a detour, i.e., the distance to be traveled by the material web inside of the respective entire arrangement is extended by the heated area in order to insert in this manner a heating distance with the necessary length into the machine.

A considerable advantage of the invention includes the fact that a smooth surface, and in particular a smooth metal surface, can be provided as the heated area that enables the optimal transmission of heat onto the material web and thus an efficient web drying. Another advantage of the invention is the fact that, by providing a heated area which is brought into contact with the material web to be dried, additional heating elements for influencing the material web with heat are not necessary.

Furthermore, due to the uninterrupted contact of the material web with the heated surface, it is not necessary to take special measures, such as, e.g., providing wire belts between heated areas and the material web in order to avoid adhesion of the material web to the heated area. According to the invention, the material web is lifted off only when, due to the relatively high firmness of the material web, the chance of a break is no longer present or at least drastically reduced. Because, according to the invention, the material web is already sufficiently firm and/or dry at the time of the separation, the lifting of the material web can occur at comparatively high web travel speeds. The invention therefore enables not only a fast drying due to the contact between the material web and the heated area, it also allows drying of the web to be performed at high machine speeds.

The invention is used particularly advantageously in producing paper or cardboard webs. Here, the heated area can be provided immediately behind the press arrangement from which the still-moist material web exits, for instance, with a dry content of about 45% to 55%. According to the invention, the material web can be dried on the heated area to such an extent that the lifting of the material web occurs at a dry matter content of, for instance, about 55–65%. In general, however, it is true that the heated area is intended to cause an increase in the dry matter content of at least 1%, preferably at least 2%, in particular at least 4%. The material web which thus already has a sufficient consistency can then be introduced into a subsequent conventional multi-cylinder drying group. The chance of adhesion onto one of the separate cylinders of this drying group no longer exists since the material web is already sufficiently dry. The multi-cylinder drying group can therefore be designed very simply, since special measures for guidance of a not yet sufficiently hardened material web are not necessary.

According to the invention, the jacket surface of the cylinder is provided as the heated area. Here, the maximal length of the heated area is determined by the diameter of the cylinder which is selected to be preferably considerably larger than the diameter of drying cylinders that are used commonly in drying groups of one or more rows in machines for producing paper or cardboard webs. The diameter of the cylinder can, for instance, be twice as large as that of conventional drying cylinders. In general, the large cylinder can also be several times larger than a comparable conventional drying cylinder.

The size of the cylinder is determined in such a way that, in particular dependent on the web travel speed and the drying ratio that can be achieved with the heated surface, a heating zone is provided between the feeding zone in which the material web is fed to the heating area and is set onto the jacket area of the cylinder and a removal zone in which the material web is lifted off the heated area, which heating zone is long enough in the web travel direction to ensure a sufficiently high firmness of the material web in the removal zone.

According to an alternative embodiment of the invention, the heated area is provided in the form of the outer surface of a continuous belt that is guided around at least two idle rolls. Preferably, only two rolls are provided so that the continuous belt can be guided like a conveyer. By changing the distance between the two idle rolls, the length of the heated area can be varied. In this manner, an adjustment can occur to the desired web travel or machine speed or to other characters of the material web and/or to the producing machine. In general, it is possible, according to the invention, to guide the continuous belt around more than two idle rolls.

According to another embodiment of the invention, the material web is kept in contact with the heated area by a permeable belt, preferably a wire belt, and in particular is pressed against the heated area. Preferably, a drying mesh is used which is free of any markings and is sufficiently open to enable the evaporation of the moisture contained in the material web. When using a large cylinder, it can also be covered separately to favorably influence the removal of the material web by a possible speed difference of a suction roll provided for the removal of the material web According to another embodiment of the invention, the material web is adhered to the heated area. Here, the material web is therefore not kept in contact with the heated area by special devices such as, e.g., wire belts. The adhesion of the material web occurs preferably by a pressure roll which can originate directly from a pressure felt of a preceding press arrangement below or above the heated area. For the guidance of the material web from the press arrangement to the heated area an additional feeding belt can be provided, for instance, a transfer felt, transfer wire, or transfer belt.

A device for drying a material web as well as a drying section of a machine for producing a material web is also protected by the invention.

The present invention is directed to a process for drying a material web that includes guiding the material web to at least one heated area having a jacket surface of a cylinder having a diameter of between about 4–10 meters, setting the material web, having a dry content of between about 45–55%, onto the at least one heated area, maintaining the material web in uninterrupted contact with the at least one heated area at least until the material web achieves a firmness sufficient for detaching the material web from the heated area, and detaching the material web from the at least one heated area with a dry content of between about 55%–65%.

In accordance with a feature of the instant invention, the material web can include one of a paper and a cardboard web.

According to another feature of the present invention, the material web can be positioned directly onto the heated area. Further, no intermediate layers of one or more wire belts are located between the material web and the heated area.

The at least one heated surface can include a smooth surface. Further, the smooth surface can include a smooth metal surface.

In accordance with another feature of the invention, the at least one heated area may include a continuous belt.

Further, the process can include guiding the material web from the at least one heated area to at least one multi-cylinder dryer group. A length of the contact between the material web and the at least one heated area can be larger than a circumference of the dryer cylinder which comprise the at least one multi-cylinder dryer group. The length of the contact between the material web and the at least one heated area may be considerably larger than a circumference of the dryer cylinder which comprise the at least one multi-cylinder dryer group.

Moreover, the at least one heated area may include a jacket surface of a cylinder. A diameter of the cylinder can be between about 4–10 meters. In an area of the cylinder jacket, the cylinder may include several layers. The cylinder jacket may include a circulating continuous belt. Further, the process can include heating a jacket area of the cylinder from the inside. The heating can be provided by at least one of from the inside of the cylinder by a hot fluid and from the outside by at least one of inductively and by IR-rays.

According to another feature of the invention, the at least one heated area may include the outer surface of a continuous belt guided around two idle rolls.

An inner surface of the continuous belt may be heated at least partially by at least one heating unit which is preferably positioned inside a loop formed by the continuous belt. A distance between the two idle rolls may be a multiple of a diameter of the idle rolls. One of the idle rolls can be positioned in a space between a press arrangement and a multi-cylinder dryer group, and the continuous belt can be arranged in the space to extend diagonally downwardly.

The process can further include protecting the material web in contact with the at least one heated area from falling objects. The material web may be protected from objects falling from a multi-cylinder drying group. The material web can be protected by a removal device for the material web. The removal device may include at least one transfer wire arranged to pick-up the material web from the continuous belt.

The material web can be kept in contact with the at least one heated area by a permeable belt. The permeable belt may include a wire belt. The permeable belt may be arranged to press against the at least one heated area.

The process may further include adhering the material web to the at least one heated area via a press roll.

In accordance with a further feature of the present invention, the process can include detaching the material web from the at least one heated area by a suction roll.

According to another aspect of the instant invention, the process can include exposing the material web in contact with the at least one heated area to a hot fluid comprising at least one of hot air and hot steam.

Further, the process may include detaching the material web from the heated area when a dry content of the material web is at least 1% higher than in the beginning of the heated area. The dry content can be at least 2%, and the dry content may preferably be at least 4%.

Moreover, the material web, when it is set onto the at least one heated area, may have a dry content of between about 45–55%, and the process can further include detaching the material web from the at least one heated area with a dry content of between about 55%–65%.

According to still another feature of the instant invention, the heated area can be provided at least one of immediately behind a press arrangement, immediately in front of a multi-cylinder drying group of a machine for producing a material web, and immediately in front of another drying unit. The another drying unit can include a drying cylinder.

The present invention is directed to an apparatus for drying a material web, e.g., one of a paper and a cardboard web. The apparatus includes at least one heated area comprising a jacket surface of a cylinder having a diameter of between about 4–10 meters arranged to receive the material web. The at least one heated area includes a removal zone arranged for the removal of the material web from the at least one heated area. The at least one heated area has a length sufficient to achieve, from a dry content of the material web between about 45–55% when the web is set on said at least one heated area, a dry content of the material web between about 55%–65%, which is a sufficient firmness for removing the material web from the at least one heated zone in the removal zone.

According to a feature of the invention, a wire belt may be arranged to hold the material web onto a surface of the cylinder. Guide rolls can be arranged to guide the wire belt around the cylinder. The cylinder may be heatable from at least one of the inside and the outside.

In accordance with yet another feature of the invention, the at least one heated area can include an endless conveyor arranged to transport the material web from a press device to a dryer group. Heating units can be arranged within a loop formed by said endless conveyor.

The present invention is directed to a dryer section of an apparatus for drying a material web. The dryer section includes at least one heated area comprising a jacket surface of a cylinder having a diameter of between about 4–10 meters arranged to receive the material web. The at least one heated area includes a removal zone arranged for the removal of the material web from the at least one heated area. The at least one heated area has a length sufficient to achieve, from a dry content of the material web between about 45–55% when the web is set on said at least one heated area, a dry content of the material web between about 55%–65%, which is a sufficient firmness for removing the material web from the at least one heated zone in the removal zone.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
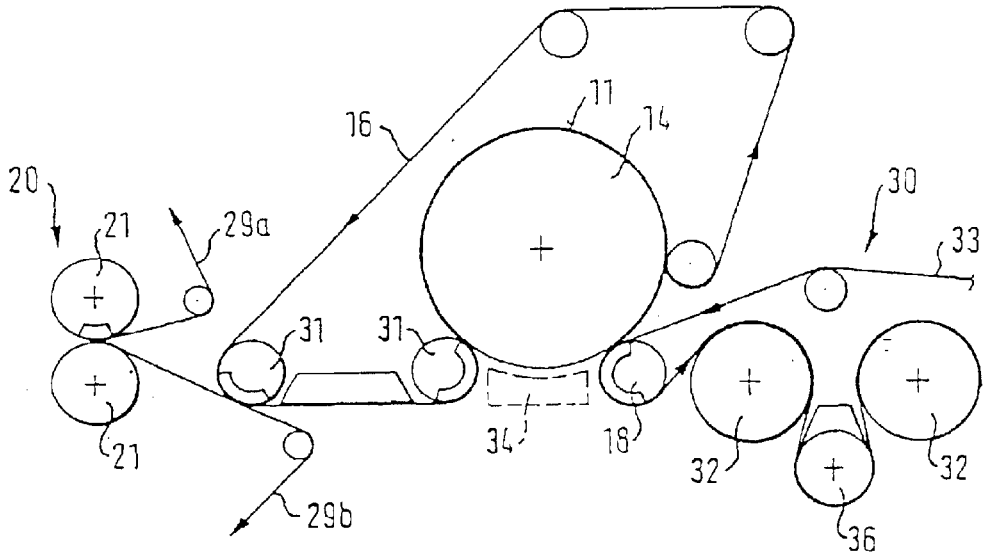
FIGS. 1, 2, and 3 illustrate various embodiments of a drying device according to the invention for performing the process according to the invention, each in a schematic representation.

FIG. 1 depicts a part of the machine for producing a material web, referred to as a paper or cardboard web in the following, in which a drying device according to the invention is provided between a press arrangement 20 and a multi-cylinder drying group 30.

The drying device contains a cylinder 14, which is partially encircled by a wire belt 16. A material web (not shown) passes through a nip formed by two pressure rolls 21 in which the material web is positioned between an upper pressure felt 29*a* and a lower pressure felt 29*b*. The material web is lifted off the lower pressure felt 29*b* by a suction roll 31 that redirects the wire belt 16. The material web is guided to the cylinder 14 by the wire belt 16 via another suction roll 31. The material web is now positioned between the jacket surface of the cylinder 14, and the wire belt 16 and is pressed onto the jacket surface of the cylinder 14 by the wire belt 16. After the removal of the wire belt 16 from the cylinder 14, the material web travels alone to a suction roll 18 which redirects a drying wire 33 of a multi-cylinder drying group 30 and which lifts the material web off the cylinder 14. By means of the suction roll 18 and the drying belt 33, the material web is then introduced into the multi-cylinder drying group of which two drying cylinders 32 and one wire suction roll 36 are depicted in FIG. 1.

The jacket surface of the cylinder 14 can be heated so that the material web is pressed by the wire belt 16 onto the heated area 11 and is dried by evaporating the moisture contained in the material web. The wire belt 16 is free of markings and sufficiently open to enable an optimal evaporation.

The heating of the cylinder jacket can occur in different ways. It is possible, for instance, to expose the cylinder jacket to a hot fluid, e.g., steam or gas, from the inside and to heat the jacket surface in such manner from the inside. Alternately or additionally, the cylinder jacket can also be heated from the outside and, in particular, inductively or by IR-rays. When the cylinder jacket is heated exclusively from the outside, in particular, it is preferred to design the cylinder jacket in several layers. This way, the heat can concentrate on the outside and can be stored there. Additionally, a multi-layered design has the advantage that material tensions created by the heating do not cause problems.

Additionally, it is possible to embody the cylinder 14 as a support roll with a comparatively low weight and to provide a circulating continuous belt whose outer side form the heated area. Such a continuous belt comprises metal preferably and provides a smooth surface for the material web. The metal belt can be heated exclusively outside of the area in which it is wrapped by the material web. This is implied in FIG. 1 by a heating device 34 which is depicted with dashed lines. When the material web is not pressed against the heated area 11 by the wire belt 16 depicted in FIG. 1, in particular, but is adhered to the heated area 11, for instance, by a pressure roll, one or more dryers or jet hoods can be provided on the cylinder 14 for increased drying performance. With such hoods, also called impingement hoods or impingement boxes, the material web can be exposed to a hot fluid, for instance, hot air or hot steam.

Figure 2:
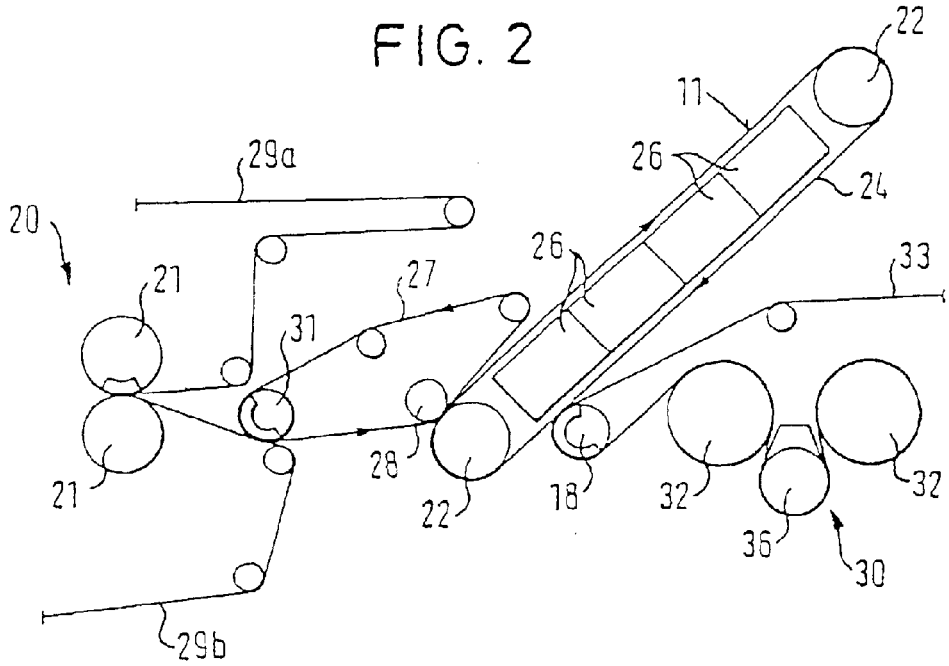

FIG. 2 depicts an embodiment of the invention in which the heated area 11 is formed by the outer side of a continuous belt 24 that wraps around two idle rolls or guiding rolls. The distance between the two idle rolls 22 is selected such that the length of the heating area for the material web formed by the heated area 11 is considerably longer than each wrapping area at the drying cylinders 32 of the multi-cylinder drying group 30. The continuous belt 24 is preferably a metal belt with a smooth surface for the material web.

Several heating units 26 are provided for heating the continuous belt 24 which are positioned inside of the loop formed by the continuous belt 24 and expose the inner surface of the continuous belt 26 to heat. Preferably, a metal belt is provided with a low resistance to heat conductivity in order to bring the outer side of the continuous belt 24 which forms the heated area 11 to the necessary temperature using as little energy as possible. The heating elements can be designed to be controllable and/or adjustable in such a way that the heat introduced to the continuous belt 24 can be varied in the web travel direction and/or perpendicular to the web travel direction.

In the embodiment of FIG. 2, a transfer felt 27 serves for the transport of the material web from the press arrangement 20 to the heated area 11. The material web is detached from the lower pressure felt 29*b* of the press arrangement 20 by a suction roll 31 that deflects the transfer felt 27. A pressure roll 28 serves to adhere the material web to the heated area 11. In this exemplary embodiment, the material web is therefore not pressed to the heated area 11 by a wire belt, but rather is only kept on the big cylinder 14 by the adhesion to the heated area 11. The removal of the material web from the heated area 11 occurs by a suction roll 18 and a drying wire 33 of the multi-cylinder drying group 30. The heating units 26 can be operated in such a way that the material web separates itself from the continuous belt 24 in the area of the suction roll 18, i.e., the removal zone, which eases the removal process.

Figure 3:
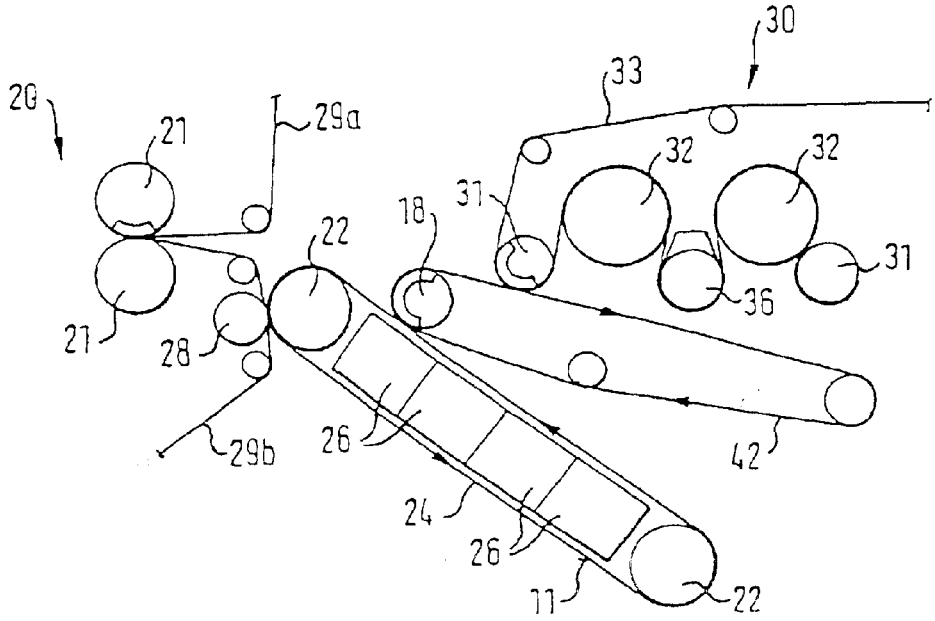

With respect to the advantages as well as the possible variations and other embodiments, the embodiment of FIG. 3 is equivalent to those of FIG. 2, insofar as nothing to the contrary is discussed below.

In the embodiment of FIG. 2, the drying device, with one of the idle rolls 22 positioned between the press arrangement 20 and the multi-cylinder drying group 30, extends diagonally upward past the press arrangements 20 and the multi-cylinder drying group 30, however, in the embodiment of FIG. 3, the drying device extends diagonally downward. In order to avoid objects originating from the multi-cylinder drying group 30, e.g., rejections or impurities created by ductors, falling onto the continuous belt 24 and the material web, a wire belt or transfer belt 42 is provided. On the one hand, the material web, detached from the heated area 11 by a suction roll 18, is introduced with a transfer wire 42 to the multi-cylinder drying group 30. For this purpose, the suction roll 18 inserts into the continuous belt 24. On the other hand, the transfer wire 42 provided an appropriate length is guided in such a way that it serves as a shield for the drying device against objects and/or impurities originating from the multi-cylinder drying group.

In the embodiment according to FIG. 3, the material web coming from the nip between the pressure roll 21 is detached directly from the lower press felt 29*b*. Here, the material web is adhered to the heated area 11 formed by the outer side of the continuous belt 24 by means of a pressure roll 28 in the zone of one of the idle rolls. In this variant as well, the operation occurs without the material web being permanently pressed by a wire belt against the heated area 11.

In general, the material web can also be detached according to the invention from the upper pressure felt 29*a* of the press arrangement 20 by either a transfer wire or a transfer felt according to the embodiment of FIG. 2 or directly by the continuous belt 24 according to the variant of FIG. 3.

The embodiments according to FIG. 2 and FIG. 3 operating with continuous belts 24 can also be provided with one or more impingement hoods or impingement boxes for increasing the drying performance, in order to additionally expose the material web to, e.g., hot air or hot steam.

The continuous belts 24 can also be guided slightly curved over the heating unit 26 in such a way that a pressing of the material web to the continuous belt 24 and a good seal of the heating units 26 is ensured. Such a bending of the continuous belts 24 is advantageous, in particular, when the heating units 26 are exposed to steam for the heating process.

The heating of the cylinder 14 or the cylinder jacket as well as the continuous belts 24 can each occur so unevenly that the drying in the web travel direction is intensified by, e.g., increasing the temperature of the heated area 11 in the web travel direction or by ensuring an increasing feed of drying energy for the heated area 11 in web travel direction.

The invention can be used particularly advantageously in producing material webs whose basis weight remains under 25 g/cm$^2$, preferably writing paper, printing paper, and cardboard webs.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Characters

11 heated area
14 cylinder
16 wire belt
18 suction roll
20 press arrangement
21 pressure roll
22 idle roll
24 continuous belt
26 heating unit
27 transfer felt
28 pressure roll
29*a* upper press felt
29*b* lower press felt
30 multi-cylinder drying group
31 suction roll
32 drying cylinder
33 drying wire
34 heating unit
36 wire suction roll
42 transfer wire

What is claimed:

1. A process for drying a material web comprising:

guiding the material web to at least one heated area comprising a jacket surface of a cylinder having a diameter of between about 4–10 meters;

setting the material web, having a dry content of between about 45–55%, onto the at least one heated area;

maintaining the material web in uninterrupted contact with the at least one heated area at least until the material web achieves a firmness sufficient for detaching the material web from the heated area;

detaching the material web from the at least one heated area with a dry content of between about 55%–65%; and guiding the material web from the at least one heated area to a dryer group composed of a plurality of dryer cylinders; and continuously supporting the material web from the setting of the material web until after the dryer group.

2. The process in accordance with claim 1, wherein the material web comprises one of a paper and a cardboard web.

3. The process in accordance with claim 1, wherein the material web is positioned directly onto the heated area.

4. The process in accordance with claim 3, wherein no intermediate layers of one or more wire belts are located between the material web and the heated area.

5. The process in accordance with claim 1, wherein the at least one heated area comprises a smooth surface.

6. The process in accordance with claim 5, wherein the smooth surface comprises a smooth metal surface.

7. The process in accordance with claim 1, wherein a length of the contact between the material web and the at least one heated area is larger than a circumference of the dryer cylinders which comprise the dryer group.

8. The process in accordance with claim 7, wherein the length of the contact between the material web and the at least one heated area is considerably larger than a circumference of the dryer cylinders which comprise the dryer group.

9. The process in accordance with claim 1, wherein, in an area of the cylinder jacket, the cylinder comprises several layers.

10. The process in accordance with claim 1, wherein the cylinder jacket comprises a circulating continuous belt.

11. The process in accordance with claim 1, further comprising heating a jacket area of the cylinder from the inside.

12. The process in accordance with claim 11, wherein the heating is provided by at least one of from the inside of the cylinder by a hot fluid and from the outside by at least one of inductively and by IR-rays.

13. The process in accordance with claim 1, further comprising protecting the material web in contact with the at least one heated area from falling objects.

14. The process in accordance with claim 13, wherein the material web is protected from objects falling from a multi-cylinder drying group.

15. The process in accordance with claim 13, wherein the material web is protected by a removal device for the material web.

16. The process in accordance with claim 15, wherein the removal device includes at least one transfer wire arranged to pick-up the material web from a continuous belt.

17. The process in accordance with claim 1, wherein the material web is kept in contact with the at least one heated area by a permeable belt.

18. The process in accordance with claim 17, wherein the permeable belt comprises a wire belt.

19. The process in accordance with claim 17, wherein the permeable belt is arranged to press against the at least one heated area.

20. The process in accordance with claim 1, further comprising adhering the material web to the at least one heated area via a press roll.

21. The process in accordance with claim 1, further comprising detaching the material web from the at least one heated area by a suction roll.

22. The process in accordance with claim 1, further comprising exposing the material web in contact with the at least one heated area to a hot fluid comprising at least one of hot air and hot steam.

23. The process in accordance with claim 1, further comprising detaching the material web from the heated area when a dry content of the material web is at least 1% higher than in the beginning of the heated area.

24. The process in accordance with claim 23, wherein the dry content is at least 2%.

25. The process in accordance with claim 23, wherein the dry content is at least 4%.

26. The process in accordance with claim 1, wherein the heated area is provided at least one of immediately behind a press arrangement, immediately in front of a multi-cylinder drying group of a machine for producing a material web, and immediately in front of another drying unit.

27. The process in accordance with claim 26, wherein the another drying unit comprises a drying cylinder.

* * * * *